United States Patent [19]

Sales et al.

[11] Patent Number: 4,893,153

[45] Date of Patent: Jan. 9, 1990

[54] COLLATION OF MULTI-PAGE DOCUMENTS

[75] Inventors: Milton S. Sales; John R. Thompson, both of Webster, N.Y.

[73] Assignee: Eastman Kodak Company, Rochester, N.Y.

[21] Appl. No.: 275,850

[22] Filed: Nov. 25, 1988

[51] Int. Cl.[4] ..... G03G 15/00

[52] U.S. Cl. ..... 355/325; 270/58

[58] Field of Search ..... 355/325, 309, 311, 321, 355/326, 328; 270/52, 58

[56] References Cited

U.S. PATENT DOCUMENTS

| | | | |
|---|---|---|---|
| 4,439,865 | 3/1984 | Kikuchi . | |
| 4,602,776 | 7/1986 | York et al. . | |
| 4,681,428 | 7/1987 | Devoy | 355/325 X |
| 4,693,590 | 9/1987 | Umeda . | |
| 4,705,393 | 11/1987 | Ito . | |
| 4,712,908 | 12/1987 | Nakayama et al. . | |
| 4,763,161 | 8/1988 | Forest et al. | 355/325 X |

FOREIGN PATENT DOCUMENTS

| | | | |
|---|---|---|---|
| 62-136477 | 6/1987 | Japan | 270/52 |

*Primary Examiner*—R. L. Moses

*Attorney, Agent, or Firm*—Milton S. Sales

[57] ABSTRACT

Multi-page documents containing at least two types of pages requiring skip frame cycles between types are produced by first producing and storing all the pages of one type and then producing all the pages of the other type. Collation is effected during production of the latter type pages, the stored pages are withdrawn from storage at appropriate times and interleaved between the other pages as they are produced. For example, all multi-color sheets can be produced one after the other in the order in which they occur in the original document and stored. Then all single-color pages can be produced in the order that they occur in the original document and sent directly to an exit tray, the multi-color pages being inserted at proper positions.

8 Claims, 3 Drawing Sheets

COLLATION OF MULTI-PAGE DOCUMENTS

CROSS-REFERENCE TO RELATED APPLICATION

Reference is made to commonly assigned U.S. patent application No. entitled COLLATION OF BUFFERED MULTI-PAGE DOCUMENTS filed in the name of J. Thompson on even date herewith.

1. Technical Field

This invention relates generally to electrostatographic machines adapted to produce multi-page documents requiring in some instances, skip frame cycles, and more particularly to the efficient frame utilization to optimize average throughput for such machines.

2. Background Art

A multi-page document to be produced may contain several multi-color pages interleaved with single-color pages. In high speed electrostatographic machines, at least one skip frame cycle is generally required when shifting from multi-color to single-color pages because the machine needs time to adjust for different fuser speeds and/or temperatures between page types. In a skip frame cycle, the print engine continues to run, but without receiver sheet feed, while appropriate adjustments to charging, toning, erasing, fusing and cleaning processes are affected. Reference is made to IBM Technical Disclosure Bulletin Vol. 28, No. 8, January 1986 for a fuller description of the skip frame cycle process.

As another example of a situation when a skip frame cycle is required, in many electrostatographic machines, the fuser speed is changed for fusing images on transparency material receiver sheets. Because of the reduced speed at which the receiver sheets travel through the fuser, several skip frame cycles may be required between transparencies and opaque receiver sheets. To produce a multi-page document which has frequent transitions which would require skip frame cycles, productivity of the marking engine is seriously impacted.

DISCLOSURE OF INVENTION

It is an object of the present invention to increase the average throughput in machines which require skip frame cycles when changing from one type of page to another by reducing the number of skip frame cycles required to produce multi-page documents which contain at least two types of interleaved pages.

By first producing all the pages of one type wherein the fuser does not change speed, and then producing all the pages of the other type, only a single skip frame cycle is required. For example, all multi-color pages can be produced and stored, one after the other in the order in which they occur in the original document. Then all single-color pages can be produced in the order that they occur in the original document, these pages being sent directly to an intermediate tray. Collation of the two types of pages is effected during production of the pages of the latter type, the stored pages being withdrawn from the intermediate tray at appropriate times and interleaved between the other pages as they are produced.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

Figure 1:
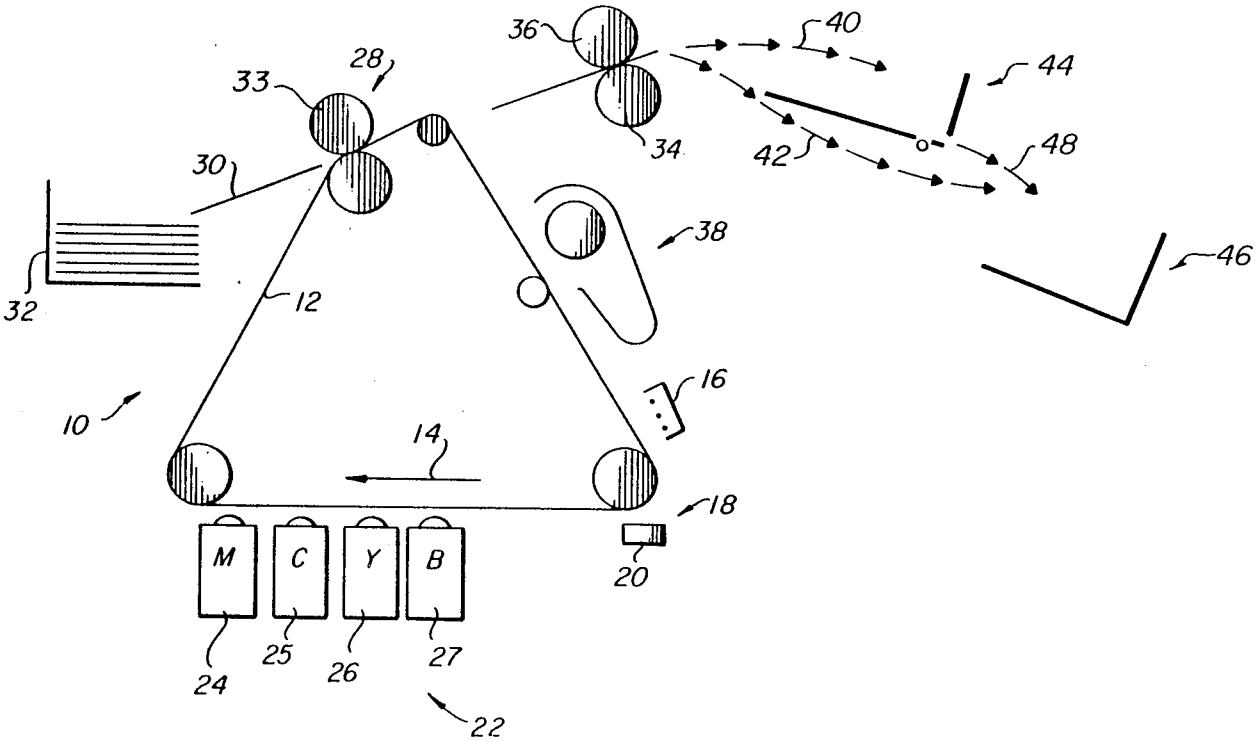
FIG. 1 is a schematic side elevational view of an electrostatographic machine in which the present invention is incorporated.

Referring to FIG. 1, an electrostatographic machine 10 is shown as a light emitting diode (LED) electronic copier/printer, but it is to be understood that other technologies are equally applicable to the present invention. for example, the machine may be an optical copier, stylus or pin recorder, etc. Electrostatographic machine 10 has an image transfer member such as photoconductive belt 12. Belt 12 is moved in a clockwise direction, as represented by arrow 14.

A charging station 16 applies an electrostatic charge to belt 12. At an exposure station 18, projected light from a write head 20 dissipates the electrostatic charge on the photoconductive belt to form a latent electrostatic image corresponding to the image of the original to be copied or printed. Write head 20 preferable has an array of LED's for exposing the photoconductive belt.

The latent electrostatic image on belt 12 is developed with toner at a developer station 22. The developer station is illustrated as having four separate substations 24, 25, 26, and 27 for processing color images; the substations containing magenta, cyan, yellow, and black toner, respectively.

As the toner image on belt 12 approaches a transfer station 28, an image receiver sheet 30 is fed from a supply 32. Transfer station 28 includes a transfer drum 33 to which the copy is secured for repeated presentations to belt 12.

When the apparatus is operating in a multi-color mode, consecutive image frames on belt 12 are developed with different colored toners using the different toning substations 24–27. The consecutive developed images are transferred in registry to receiver sheet 30 as it repeatedly is brought into transfer relation with belt 12 by drum 33. After transfer of the toner images to the receiver sheet, the receiver sheet is allowed to follow the belt, for example by removing a vacuum holding it to the drum or by stripping the sheet with a claw or other conventional stripping mechanism, not shown. The receiver sheet is separated from the belt and is passed through a pair of heated fuser rollers 34 and 36. Mechanical and electrical cleaning of belt 12 is effected at a cleaning station 38.

In many electrostatographic machines, fuser rollers 34 and 36 are slowed for certain, specified operations, such as for fusing multi-color images on receiver sheets and/or transparency material receiver sheets. Because of the reduced speed at which the sheets travel through the fuser rollers, several skip frame cycles are required between multi-color pages and single color pages, and between transparency pages and opaque receiver sheet pages.

After the pages have passed through fuser rollers 34 and 36, they are selectively directed along one of a pair of paths 40 or 42 to trays 44 or 46, respectively. Tray 46 is a conventional discharge tray, while tray 44 is a first-in, first-out (FIFO) intermediate tray. FIFO tray 44 permits pages to be discharged along a path 48 to tray 46. Selection of tray 44 or 46 for any particular page, and of at what time during the production of a multi-page document a page is released from tray 44 to tray 46 is controlled by machine logic as set forth below.

Figure 2:
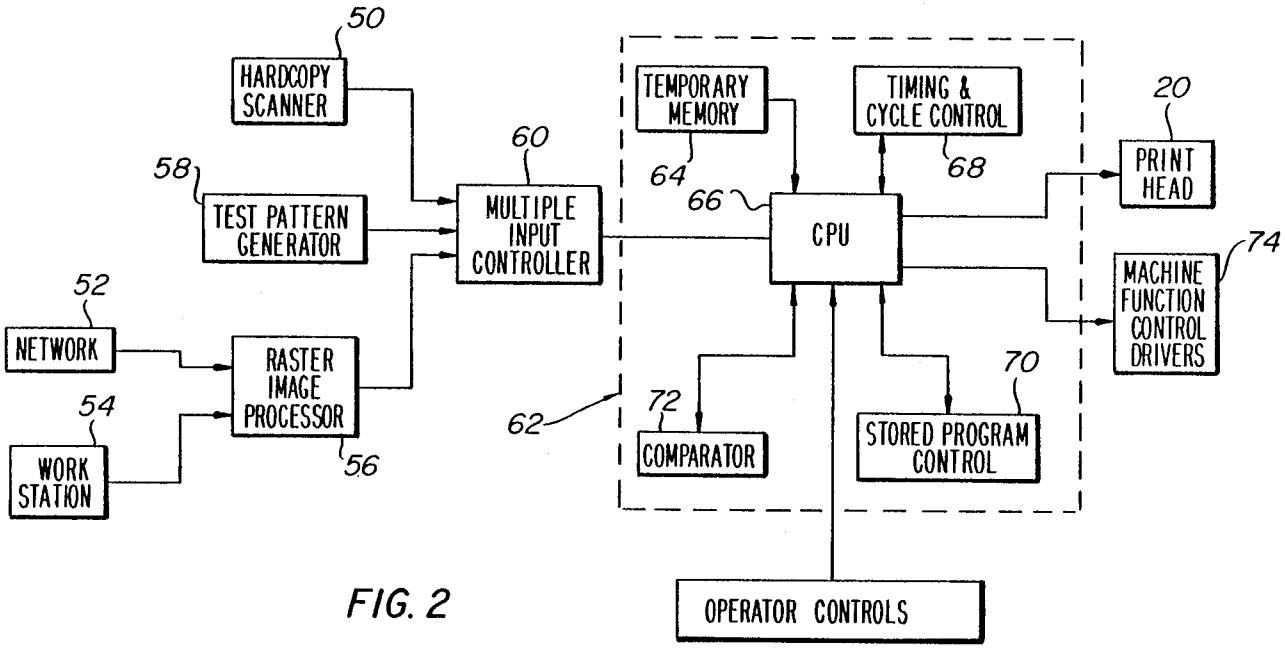
FIG. 2 is a block diagram of the machine shown in FIG. 1, showing a logic and control unit.

Referring to FIG. 2, electrostatographic machine 10 receives electrical image information signals in any of several ways. For example, a document scanner 50 optically scans hard copy originals and converts the image to an electrical signal. Image information may also be obtained from electrical rather than optical sources. That is, electrical image information signals may originate (insofar as electro-stratographic machine 10 is concerned) from a computer network 52 or a work station 54. Electrical image information signals from the network or work station is rasterized by a raster image processor (RIP) 56. Image information may also come from a test pattern generator 58. The image signals are applied to write head 20 by a multiple input controller 60 under control of a logic and control unit (LCU) 62.

Programming of a number of commercially available microprocessors is a conventional skill well understood in the art. The following disclosure is written to enable a programmer having ordinary skill in the art to produce an appropriate control program for a microprocessor. The particular details of any such program would, of course, depend on the microprocessor architecture designated.

Referring still to FIG. 2, LCU 62 consists of temporary data storage memory 64, a central processing unit (CPU) 66, a timing and cycle control unit 68, a stored program control 70, and a data comparator 72. Temporary data storage memory 64 may be conveniently provided by a conventional, Read/Write memory or Random Access Memory (RAM). Stored program control 70 includes one or more conventional Read Only Memories (ROM) containing operational programs in the form of binary words corresponding to instructions and values. The programs stored in ROM are responsive to various input signals for sequentially actuating and de-actuating the work stations described above with reference to FIG. 1, as well as for controlling the operation of many other machine functions by means of control drivers 74, as disclosed in U.S. Pat. No.

3,914,047.

Figure 3:
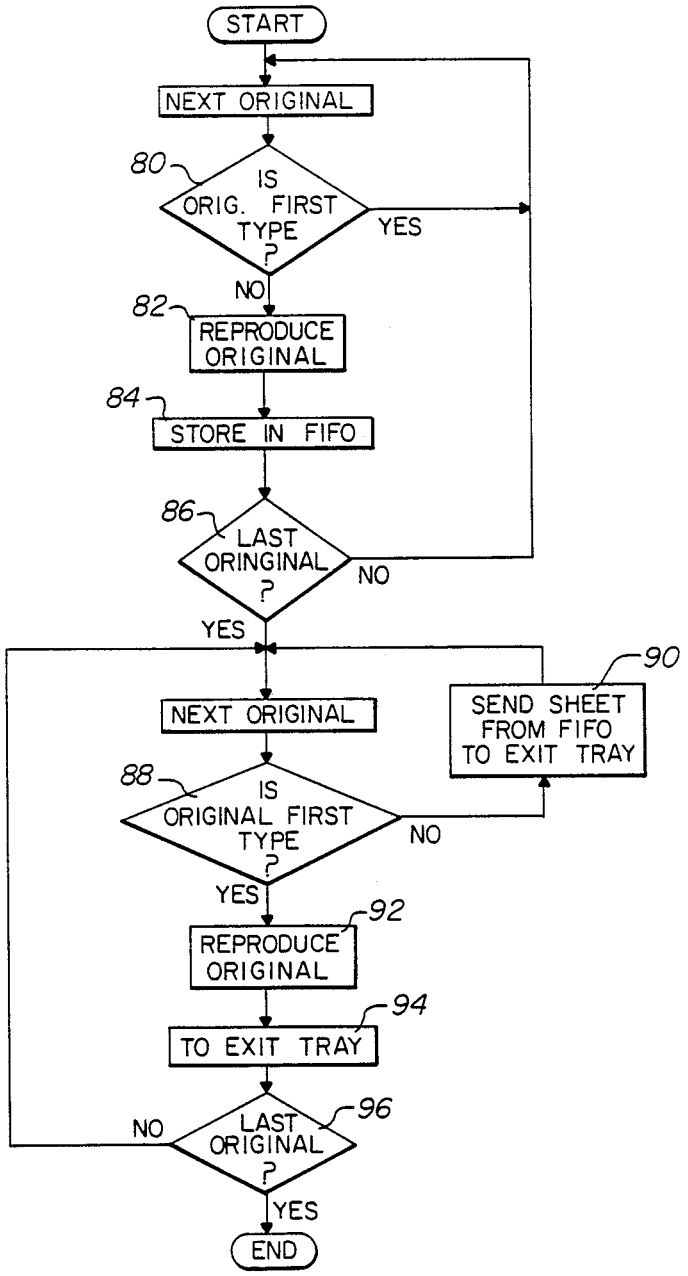
FIG. 3 is a flow chart of the operation of the apparatus of FIG. 1 in accordance with one aspect of the present invention.

FIG. 3 is a logic flow chart showing the steps for reproducing a multi-original document containing interleaved types or originals requiring skip frame cycles between types. After the reproduction process is started, the decision is made at block 80 whether the next original is a page of a first, predetermined type. If yes, the original is passed over, and the same decision is made for the next succeeding original. Had the decision at block 80 been no instead of yes, the original would have been reproduced (block 82) and the reproduction deposited in a FIFO intermediate tray (block 84). The process is repeated until all originals have been reviewed as determined at decisional block 86.

Now the multi-original document is again inspected, and the decision is made at block 88 whether the next original is a page of the first predetermined type. If not, that original is passed over, and, referring to block 90, a sheet is removed from the FIFO intermediate tray and sent to the exit tray. Had the decision at block 88 been yes instead of no, the original would have been reproduced (block 92) and the reproduction deposited directly in the exit tray (block 94). The process is repeated until all originals have been reviewed as determined at decisional block 96.

In printers having print server computers which interface between network 52 or work station 54 and the rest of the system, jobs and file handling data coming in from various places in the network are buffered in a mass storage. The print server may be programmed to select the pages to be sent to the marking engine in the proper order so that all pages requiring one fuser speed and/or temperature are produced before those requiring another fuser speed and/or temperature.

In copiers having recirculating document feeders, provision may be made for designating originals requiring different fuser speeds and/or temperature. Designation may be done by any of several known methods, including from operator keyboard, marks on the originals which can be detected by the feeder, key sheets inserted into the multi-page document, etc. Once designated, the multi-page document circulates through the feeder, and those originals requiring one fuser speed and/or temperature are reproduced. Then, the multi-page document is re-circulated through the feeder a second time, and the originals requiring the other fuser speed and/or temperature are reproduced.

The invention has been described in detail with particular reference to preferred embodiments thereof, but it will be understood that variations and modifications can be effected within the spirit and scope of the invention.

What is claimed is:

1. In an electrostatographic machine adapted to reproduce multi-original documents containing interleaved types of originals requiring skip frame cycles between types, the improvement comprising:

means for reproducing all originals of one type;

means for storing the reproductions of the originals of said one type;

means for reproducing all the originals of the other type; and means, operative during the reproduction of the originals of said other type, for delivering the reproductions of said one type original seriatim from said storage means into the reproduction document in collated fashion at the position corresponding to the position of the associated original in the multi-original document.

2. The improvement as defined in claim 1 wherein said storage means is adapted for first-in, first-out, sheet storage.

3. The improvement as defined in claim 2 wherein said storage means is an intermediate tray.

4. In an electrostatographic machine adapted to produce collated multi-page reproductions of a multi-original document containing interleaved types of originals requiring skip frame cycles between types, the improvement comprising:

means for producing all pages of one of said types;

means for storing said pages of said one type;

means for producing all pages of the other of said types, and means, operative during the production of said pages of the other type, for delivering said stored pages into the document being produced in collated fashion to form a stack of interleaved types of pages.

5. The improvement as defined in claim 4 wherein said storage means is adapted for first-in, first-out sheet storage.

6. The improvement as defined in claim 5 wherein said storage means is an intermediate tray.

7. The process of reproducing multi-original documents containing interleaved types of originals requiring skip frame cycles between types, said process comprising:

reproducing all originals of one type;

storing the reproductions of the originals of said one type;

reproducing all the originals of the other type; and during the reproduction of the originals of said other type, delivering the reproductions of said one type original seriatim from said storage means into the reproduction document in collated fashion at the position corresponding to the position of the associated original in the multi-original document.

8. The process of producing collated multi-page reproductionss of a multi-original document containing interleaved types of originals requiring skip frame cycles between types, the improvement comprising:

producing all pages of one of said types;

storing said pages of said one type;

producing all pages of the other of said types, and during the production of said pages of the other type, delivering said stored pages into the document being produced in collated fashion to form a stack of interleaved types of pages.

* * * * *